US007861797B2

(12) United States Patent
Hartmann et al.

(10) Patent No.: US 7,861,797 B2
(45) Date of Patent: Jan. 4, 2011

(54) HAND-HELD MACHINE TOOL WITH SLIP CLUTCH

(75) Inventors: Markus Hartmann, Mauerstetten (DE); Manfred Ludwig, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 284 days.

(21) Appl. No.: 11/807,677

(22) Filed: May 29, 2007

(65) Prior Publication Data

US 2007/0289759 A1 Dec. 20, 2007

(30) Foreign Application Priority Data

May 30, 2006 (DE) ..... 10 2006 000 252

(51) Int. Cl.
*B25D 15/00* (2006.01)
*B25D 16/00* (2006.01)
*B25D 11/12* (2006.01)

(52) U.S. Cl. ..... 173/178; 173/104; 173/48; 192/56.62

(58) Field of Classification Search ..... 173/178; 192/56.61, 56.62; 464/39
See application file for complete search history.

(56) References Cited

U.S. PATENT DOCUMENTS 2,068,745 A * 1/1937 Hall ..... 173/178
2,128,761 A * 8/1938 Thomas ..... 173/93
2,160,150 A * 5/1939 Jimerson et al. ..... 173/93.6
2,220,711 A * 11/1940 Fitch ..... 173/93.6
2,753,965 A * 7/1956 Kaman ..... 173/93.6
2,889,902 A * 6/1959 Harrison et al. ..... 477/11
2,907,240 A * 10/1959 Schwenk et al. ..... 173/93.6
3,275,116 A * 9/1966 Martin ..... 192/150
3,331,452 A * 7/1967 Wanner ..... 173/178
3,616,883 A * 11/1971 Sindelar ..... 192/56.61
4,429,775 A * 2/1984 Teramoto ..... 477/178
4,719,976 A * 1/1988 Bleicher et al. ..... 173/109
4,809,572 A * 3/1989 Sasaki ..... 81/429
4,901,610 A * 2/1990 Larson et al. ..... 81/473

(Continued)

FOREIGN PATENT DOCUMENTS

DE 3804414 A1 * 8/1989

(Continued)

*Primary Examiner*—Rinaldi I. Rada
*Assistant Examiner*—Lindsay Low
(74) *Attorney, Agent, or Firm*—Abelman, Frayne & Schwab

(57) ABSTRACT

An at least partially rotating and axially percussive hand-held machine tool (4) has an impact mechanism (5) with a guide tube (6) in which a percussion piston (7) is driven in an axially percussive manner by a pneumatic spring (8) and with a slip clutch (10) which is driven in rotation, encloses the guide tube (6), is provided axially with cams (9), and has a driving sleeve (11) and driven sleeve (12) which are biased axially relative to one another under pressure by a spring (13). The driving sleeve (11) is connected by positive engagement to a control sleeve (14) coaxial to the driving sleeve by balls (18) which partially engage, respectively, in two control contours (19*a*, 19*b*) of the driving sleeve (11) and of the control sleeve (14), which control contours (19*a*, 19*b*) are arranged partially opposite one another, and the driving sleeve (11) is positively guided in such a way that the driving sleeve (11), which is axially biased under pressure by the spring (13), is displaced axially and rotated relative to the control sleeve (14) when a limiting torque is exceeded.

20 Claims, 3 Drawing Sheets

U.S. PATENT DOCUMENTS 4,967,888 A * 11/1990 Lippacher et al. ..... 192/56.5
5,005,684 A * 4/1991 Fujii ..... 192/56.57
5,092,441 A * 3/1992 Fujii ..... 192/56.54
5,134,909 A * 8/1992 Sasaki ..... 81/473
5,209,308 A * 5/1993 Sasaki ..... 173/178
5,307,912 A * 5/1994 Girguis ..... 192/56.1
5,346,023 A * 9/1994 Takagi et al. ..... 173/178
5,588,496 A * 12/1996 Elger ..... 173/178
5,778,989 A * 7/1998 Neumaier ..... 173/178
5,836,403 A * 11/1998 Putney et al. ..... 173/205
7,051,820 B2 * 5/2006 Stirm ..... 173/109
7,216,749 B2 * 5/2007 Droste ..... 192/56.61
7,303,026 B2 * 12/2007 Frauhammer et al. ..... 173/48
7,422,075 B2 * 9/2008 Hahn ..... 173/178
2004/0026099 A1 * 2/2004 Stirm ..... 173/178

FOREIGN PATENT DOCUMENTS

EP 212381 A1 * 3/1987

* cited by examiner

HAND-HELD MACHINE TOOL WITH SLIP CLUTCH

BACKGROUND OF THE INVENTION

1. Field of the Invention

The invention is directed to an at least partially rotating and axially percussive hand-held machine tool such as a multipurpose hammer having an impact mechanism and a slip clutch arranged at the guide tube of the pneumatic spring.

2. Description of the Prior Art

Particularly in percussive rotary drilling in reinforced concrete, the drilling head can become hooked on embedded reinforcing iron resulting in a rotation of the housing. For this reason, a safety clutch arranged between the driving motor and the tool receptacle reliably interrupts the flow of force in case of tool blockage.

In a safety clutch constructed as a slip clutch, the flow of force is interrupted as soon as a permissible maximum torque is exceeded. When the slip clutch is additionally constructed as a frictionally locking slip clutch, torque fluctuations that can help to unhook the drilling head are generated in case of tool blockage with repeated engagement of the flow of force. These torque fluctuations must be absorbed substantially by the user.

Further, particularly in high-power hand-held machine tools having a power rating of more than 1000 Watts, another safety clutch is designed as an electronically controlled magnetic clutch and is arranged in the flow of force before the transmission gear unit and behind the rapidly rotating motor, where substantially smaller coupling torques occur.

In a rotating and axially percussive hand-held machine tool according to DE 4304899, a first, lockable slip clutch is arranged on the guide tube and a second slip clutch is arranged in the flow of force in front of the transmission gear unit.

In a rotating and axially percussive hand-held machine tool according to EP 1207018, a safety clutch is constructed as an electronically controlled magnetic clutch and is arranged in the flow of force in front of the transmission gear unit directly behind the rapidly rotating motor.

In a rotating and axially percussive hand-held machine tool according to DE3804414, a slip clutch surrounding the rotatable guide tube has a driving sleeve that is driven in rotation by a bevel pinion and has a female bevel sleeve which is biased axially by a pressure spring, and by which balls that are radially displaceable in rotary driving holes of the driving sleeve are pressed into matching ball depressions of the guide tube for rotary driving.

According to DE10033100, a rotating and axially percussive hand-held machine tool has an impact mechanism with a rotating guide tube in which a percussion piston is driven in an axially percussive manner by a pneumatic spring. A slip clutch, which encloses the guide tube and is provided axially with cams, has a driving sleeve that is driven in rotation by a bevel pinion and a driven sleeve. The driving sleeve and driven sleeve are axially biased relative to one another under pressure by a spring. The driven sleeve is connected to the guide tube so as to be axially displaceable and fixed with respect to rotation relative to it.

Further, U.S. Pat. No. 2,907,240 and GB963533 disclose rotating and tangentially percussive impact wrenches with a slip clutch which is constructed as a tangential impact mechanism and provided axially with cams, and comprises a rotationally driven solid cylindrical control shaft having V-shaped grooves in which balls engage, where each ball is arranged in an associated triangular pocket of a driving part that is displaceable in an axially spring-biased manner.

SUMMARY OF THE INVENTION

It is the object of the invention to provide a rotating and axially percussive hand-held machine tool which generates tangential impact pulses also when used for its intended purpose.

Accordingly, an at least partially rotating and axially percussive hand-held machine tool has an impact mechanism with a guide tube in which a percussion piston is driven in an axially percussive manner by a pneumatic spring. A slip clutch, which is driven in rotation and encloses the guide tube, is provided axially with cams, and has a driving sleeve and driven sleeve which are biased axially relative to one another under pressure by a spring, and the driving sleeve is connected by positive engagement to a control sleeve coaxially to the driving sleeve by balls which partially engage, respectively, in two control contours of the driving sleeve and of the control sleeve, which control contours are arranged partially opposite one another, and the driving sleeve is positively guided in such a way that the driving sleeve, which is axially biased under pressure by the spring, is displaced axially and rotated relative to the control sleeve when a limiting torque is exceeded.

By means of the axially toothed slip clutch which is constructed with a driving sleeve that is rotated in a positively guided manner, the cams strike one another in the manner of a tangential impact mechanism when engaging and directly generate tangential impact pulses at the driven sleeve which propagate with low damping over the tool receptacle and the percussive drilling tool to the drilling head. Since the action of the tangential impact pulses is of a substantially shorter duration, although with substantially higher torque peaks than the torque fluctuations occurring merely by the engagement of the flow of force, a tool blockage that may be initiated as torque increases can be overcome at least after a few tangential impacts without resulting in a prolonged tool blockage leading to prolonged interruption of the flow of force. In addition, the brief tangential impact pulses are substantially intercepted by the moment of inertia of the hand-held machine tool and are therefore hardly noticed by the user.

The first control contour is advantageously formed as a broad pocket (with respect to the balls) with at least one side extending axially at an inclination. The second control contour is formed as an elongated groove which extends at least partially at an opposite inclination axially (advantageously by the same magnitude as the side) so that the limiting torque at which the tangential impact is initiated is defined by the opposed inclinations of the side and the groove in that, owing to the relaxing of the spring that is now made possible, the driving sleeve is accelerated without constraint within the free space of the broad pocket and strikes the driven sleeve tangentially.

The first control contour is advantageously formed as a triangular pocket with the apex situated axially on the spring side and two sides extending respectively at an inclination axially. The second control contour is formed as an elongated groove which extends axially at an opposite inclination so as to be angled in a V-shaped manner so that tangential impact pulses are generated in both rotational directions of the tool receptacle when a limiting torque is exceeded, which is advantageous for freeing a prolonged tool blockage.

The control sleeve is advantageously arranged coaxially inside the driving sleeve so that the driving sleeve with the cams is outwardly exposed with respect to the slip clutch.

The driven sleeve is advantageously connected directly to the tool receptacle and is advantageously formed integral therewith so that the tangential impact pulses are transmitted to the rotary percussion mechanism with minimal damping.

The torque-transmitting flank surfaces of the cams of the driving sleeve and of the driven sleeve of the axially toothed slip clutch are advantageously oriented so as to be exactly tangential so that no radial or axial force components occur in the engaged state during rotational driving.

In an advantageous manner, there are at least two cams distributed circumferentially in a symmetric manner for the driving sleeve and driven sleeve, respectively, so that no axial bending moment is generated during rotational driving.

In an advantageous manner, another safety clutch, advantageously constructed as an electronically controlled magnetic clutch, is arranged in the flow of force between the driven motor and the transmission gear unit which is advantageously constructed as a bevel gear unit so that, in case of a tool blockage, the flow of force can be interrupted redundantly. In addition, different criteria can be used for initiating the two clutches, e.g., limiting torques of different magnitudes occurring at the rotary percussive tool or calculated limiting deflections of the housing.

The invention will be described more fully with reference to an advantageous embodiment example.

Figure 1:
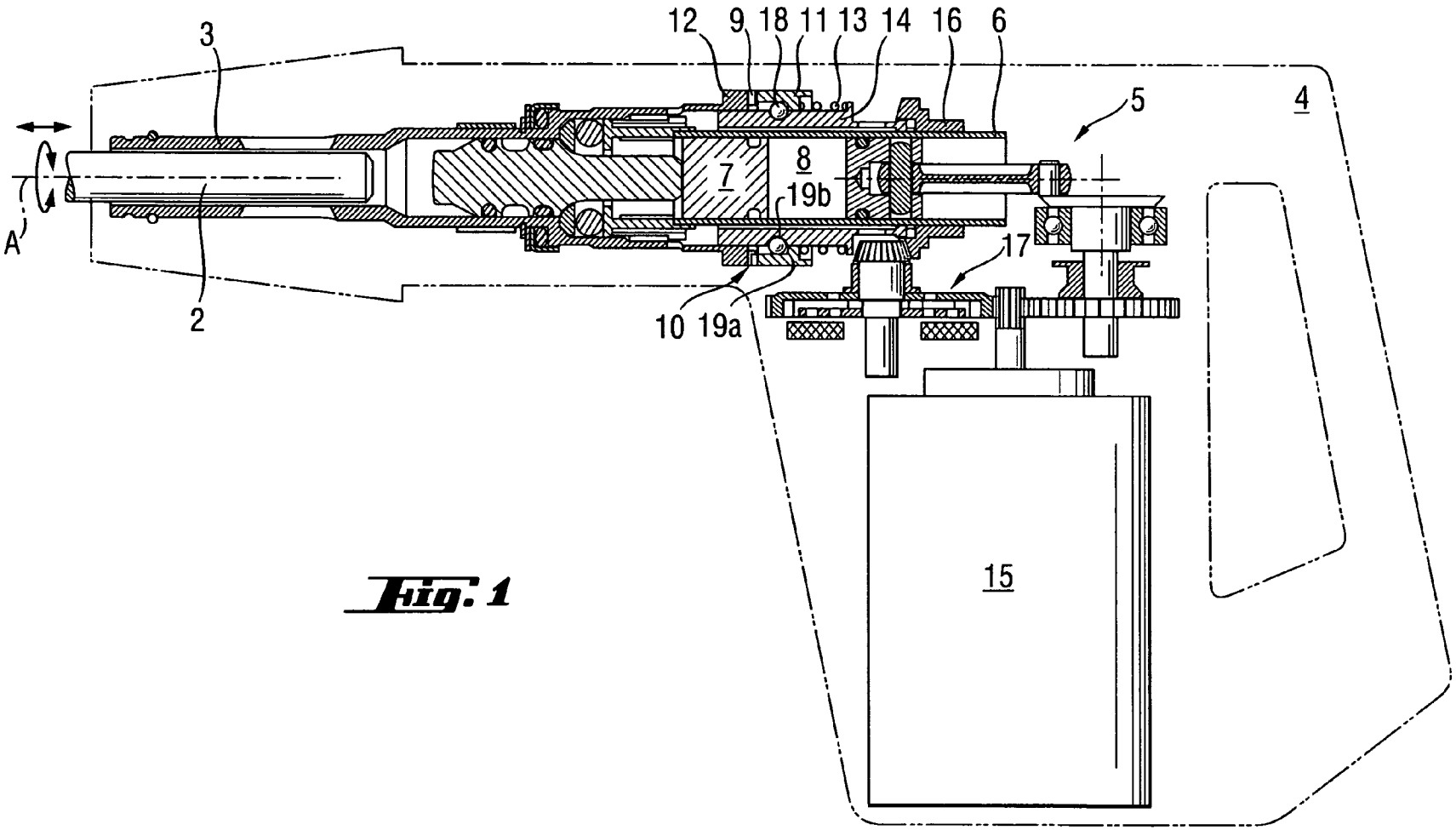
FIG. 1 a hand-held machine tool in longitudinal section.
Figure 3:
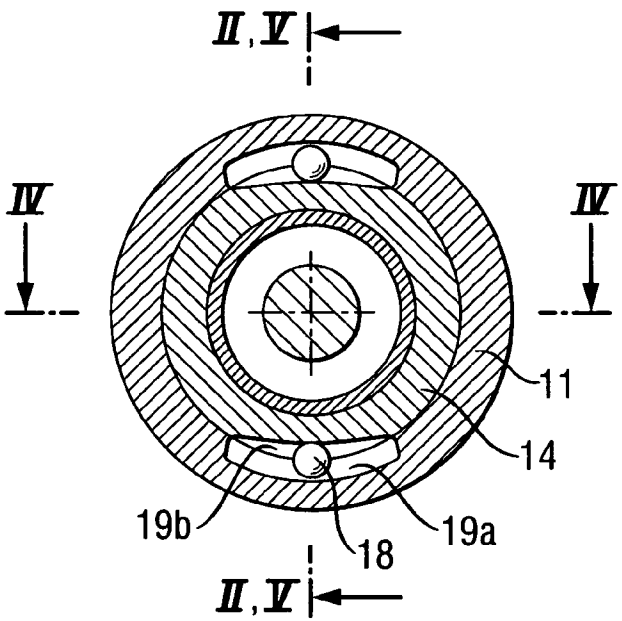
FIG. 3 a cross section along line III-III of FIG. 2.
Figure 2:
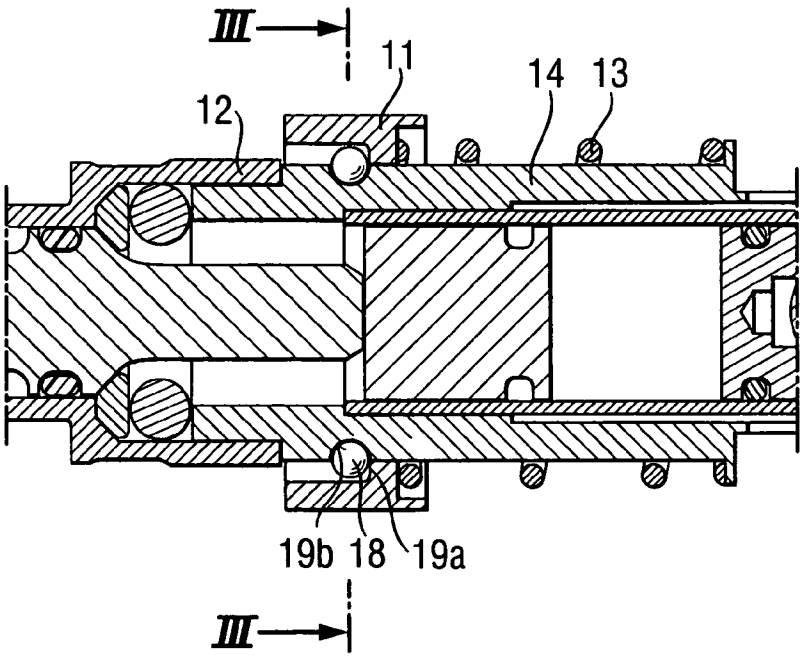
FIG. 2 a detail with slip clutch in longitudinal section along line II-II in FIG. 3.

To facilitate understanding of the invention, identical reference numerals have been used, when appropriate, to designate the same or similar elements that are common to the figures. Further, unless stated otherwise, the drawings shown and discussed in the figures are not drawn to scale, but are shown for illustrative purposes only.

DETAILED DESCRIPTION OF THE PREFERRED EMBODIMENTS

Referring to FIG. 1, a hand-held machine tool 4 drives a rotary drilling tool 2 by means of a tool receptacle 3, which rotates with respect to an axis A (selectively in clockwise or counterclockwise rotation) and strikes axially. The hand-held machine tool 4 further includes an impact mechanism 5 having a guide tube 6 in which a percussion piston 7 is driven in an axially percussive manner by a pneumatic spring 8.

Further, a rotationally driven slip clutch 10 which encloses the guide tube 6 is provided as a safety clutch. The slip clutch 10 includes axial cams 9 (FIG. 4), as well as driving sleeve 11 and driven sleeve 12 which are axially biased relative to one another under pressure by a spring 13. A control sleeve 14, which is connected to the driving sleeve 11 by balls 18, is arranged coaxially within the driving sleeve 11. The driven sleeve 12 is constructed so as to be connected directly to the tool receptacle 3 and be integral therewith.

Another (second) safety clutch 17 can be provided in the form of an electronically controlled magnetic clutch, which is arranged in the flow of force between a driving motor 15 and a transmission gear unit 16 which for example, is constructed as a bevel gear unit for the rotary driving.

Referring to FIGS. 2 to 5, the driving sleeve 11 is connected by positive engagement to the control sleeve 14 extending coaxial to the driving sleeve 11 by balls 18. The balls 18 partially engage, respectively, in two control contours 19*a*, 19*b* formed in the control sleeve 14 and driving sleeve 11, respectively, and which are arranged partially opposite one another. When a limiting torque of the slip clutch 10 is exceeded, the driving sleeve 11, which is biased axially relative to the control sleeve 14 under pressure by the spring 13, is displaced axially relative to the control sleeve 14 and rotated by the force along the control contours 19*a*, 19*b*.

The driving sleeve 11 is rotated until the exactly tangentially oriented torque-transmitting flank surfaces 20 (FIG. 5) of the two respective cams 9 (shown in partial dashed lines in FIG. 5 because of the cutaway portion), which are symmetrically displaced in a revolving manner and engage axially one inside the other on opposite sides, are disengaged and rotate past one another with low friction. The relaxing of the spring 13, which is made possible after the cams slide past, causes the driving sleeve 11 to be displaced to the rear axially and to be freely accelerated in rotation inside the free space of the control contours 19*a*, 19*b* with respect to the control sleeve 14. The driving sleeve 11 strikes against the driven sleeve 12 by means of the torque-transmitting flank surface 20 of the cams 9, which now engage one inside the other again, and accordingly transforms its rotational energy in its entirety into a brief tangential percussion which is transmitted to the rotary drilling tool 2 (FIG. 1) by the tool receptacle 3 (FIG. 1).

Figure 4:
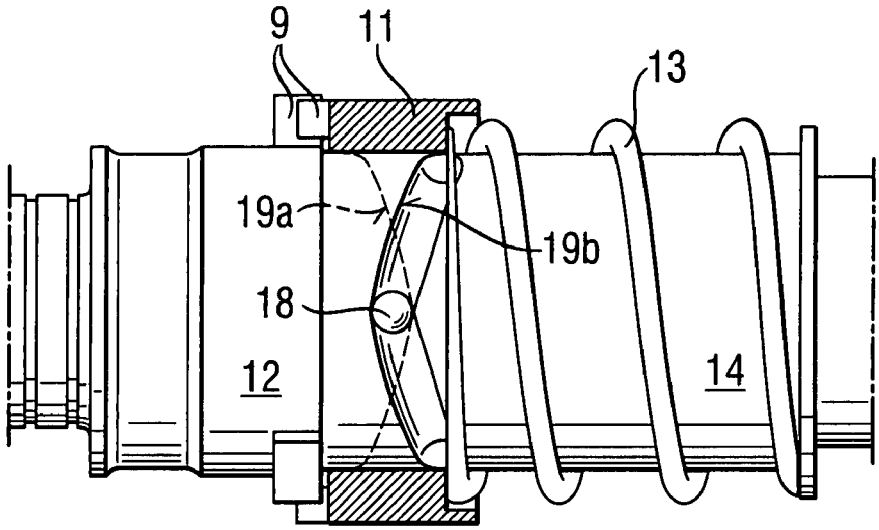
FIG. 4 a partial longitudinal sections offset by 90° along lines IV-IV of FIG. 3.
Figure 5:
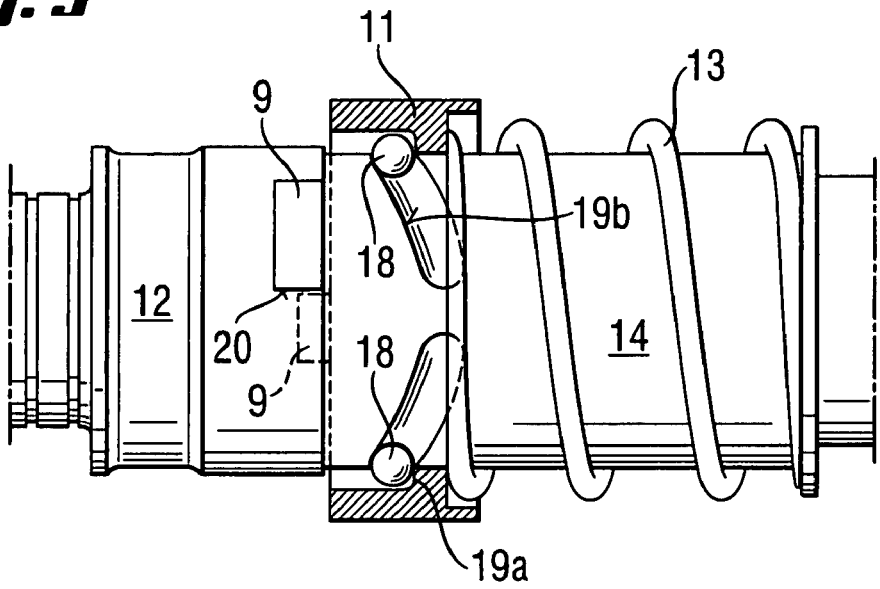
FIG. 5 a partial longitudinal sections offset by 90° along lines V-V of FIG. 3.

Referring to FIG. 4 and FIG. 5, the first control contour 19*a* (shown in dashes because of the cutaway portion) formed by the control sleeve 14 is formed as a triangular pocket which is broad with respect to the balls 18 and whose apex lies axially on the spring side and whose sides extend diagonally. The second control contour 19*b* formed by the driving sleeve 11 is constructed as an axially opposite groove, which is angled in a V-shaped manner and extends axially at an inclination in the opposite direction by the same magnitude as the sides.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. An at least partially rotating and axially percussive hand-held machine tool having a tool receptacle for receiving a tool, comprising:

an impact mechanism (5) having a guide tube (6) in which a percussion piston (7) is driven in an axially percussive manner by a pneumatic spring (8);

a driving motor (15);

a slip clutch (10), encloses the guide tube (6), is provided axially with cams (9) having torque-transmitting flank surfaces (20), and has a driving sleeve (11) and a driven sleeve (12) which are biased axially towards one another under pressure by a spring (13), and a control sleeve (14) which is driven in rotation by the driving motor (15) for driving the driving sleeve (11) to, thereby, drive in rotation the slip clutch (10);

wherein the driving sleeve (11) is connected by positive engagement to the control sleeve (14) coaxial to the driving sleeve (11) by balls (18) which partially engage, respectively, in two control contours (19*a*, 19*b*) of the driving sleeve (11) and of the control sleeve (14), which control contours (19*a*, 19*b*) are arranged partially opposite one another, and wherein the driving sleeve (11) is positively guided in such a way that the driving sleeve (11), which is axially biased under pressure by the spring (13), is displaced axially away from the driven sleeve (12) and rotated relative to the control sleeve (14) when a limiting torque is exceeded and then is displaced axially towards the driven sleeve (12) under action of the spring (13), whereby the driving sleeve (11) strikes the driven sleeve (12) with the torque-transmitting flank surfaces (20) so that a rotational energy of the driving sleeve (11) is transformed into a brief tangential percussion which is transmitted to the tool by the tool receptacle.

2. A hand-held machine tool according to claim 1, wherein the first control contour (19*a*) is formed as a broad pocket with at least one side extending axially at an inclination, and the second control contour (19*b*) is formed as an elongated groove which extends at least partially at an opposite inclination axially.

3. A hand-held machine tool according to claim 2, wherein the first control contour (19*a*) is formed as a triangular pocket whose apex is situated axially on the spring side and whose two sides extend, respectively, at an inclination axially, and the second control contour (19*b*) is formed as an elongated groove which extends axially at an opposite inclination so as to be angled in a V-shaped manner.

4. A hand-held machine tool according to claim 1, wherein the control sleeve (14) is arranged coaxially inside the driving sleeve (11).

5. A hand-held machine tool according to claim 1, wherein the driven sleeve (12) is connected directly to the tool receptacle (3).

6. A hand-held machine tool according to claim 1, wherein the torque-transmitting flank surfaces (20) of the cams (9) of the driving sleeve (11) and of the driven sleeve (12) of the slip clutch (10) are exactly tangentially oriented.

7. A hand-held machine tool according to claim 1, wherein at least two cams (9) are distributed circumferentially in a symmetric manner for the driving sleeve (11) and driven sleeve (12), respectively.

8. A hand-held machine tool according to claim 1, further comprising a transmission gear unit (16), said transmission gear unit (16) being driven by said driving motor (15) to rotate said impact mechanism (5), wherein a second safety clutch (17) is arranged in the flow of force between the driver motor (15) and the transmission gear unit (16).

9. An at least partially rotating and axially percussive hand-held machine tool having a tool receptacle for receiving a tool, comprising:

an impact mechanism (5) having a guide tube (6) in which a percussion piston (7) is driven in an axially percussive manner by a pneumatic spring (8);

a driving motor (15);

a slip clutch (10), encloses the guide tube (6), is provided axially with cams (9) having torque-transmitting flank surfaces (20), and has a driving sleeve (11) and a driven sleeve (12) which are biased axially towards one another under pressure by a spring (13); and a control sleeve (14) which is driven in rotation by the driving motor (15) for driving the driving sleeve (11) to, thereby, drive in rotation the slip clutch (10);

wherein the driving sleeve (11) is positively guided in such a way that the driving sleeve (11), which is axially biased under pressure by the spring (13), is displaced axially away from the driven sleeve (12), is rotationally decoupled from the driving motor (15), and is freely rotated relative to the control sleeve (14) when a limiting torque is exceeded and then is displaced axially towards the driven sleeve (12) under action of the spring (13), whereby the driving sleeve (11) strikes the driven sleeve (12) with the torque-transmitting flank surfaces (20) so that a rotational energy of the driving sleeve (11) is transformed into a brief tangential percussion which is transmitted to the tool by the tool receptacle.

10. A hand-held machine tool according to claim 9, wherein the first control contour (19*a*) is formed as a broad pocket with at least one side extending axially at an inclination, and the second control contour (19*b*) is formed as an elongated groove which extends at least partially at an opposite inclination axially.

11. A hand-held machine tool according to claim 10, wherein the first control contour (19*a*) is formed as a triangular pocket whose apex is situated axially on the spring side and whose two sides extend, respectively, at an inclination axially, and the second control contour (19*b*) is formed as an elongated groove which extends axially at an opposite inclination so as to be angled in a V-shaped manner.

12. A hand-held machine tool according to claim 9, wherein the control sleeve (14) is arranged coaxially inside the driving sleeve (11).

13. A hand-held machine tool according to claim 9, wherein at least two cams (9) are distributed circumferentially in a symmetric manner for the driving sleeve (11) and driven sleeve (12), respectively.

14. A hand-held machine tool according to claim 9, further comprising a transmission gear unit (16), said transmission gear unit (16) being driven by said driving motor (15) to rotate said impact mechanism (5), wherein a second safety clutch (17) is arranged in the flow of force between the driver motor (15) and the transmission gear unit (16).

15. An at least partially rotating and axially percussive hand-held machine tool having a tool receptacle for receiving a tool, comprising:

an impact mechanism (5) having a guide tube (6) in which a percussion piston (7) is driven in an axially percussive manner by a pneumatic spring (8);

a driving motor (15);

a slip clutch (10), encloses the guide tube (6), is provided axially with cams (9) having torque-transmitting flank surfaces (20), and has a driving sleeve (11) and a driven sleeve (12) which are biased axially towards one another under pressure by a spring (13): and a control sleeve (14) which is driven in rotation by the driving motor (15) for driving the driving sleeve (11) to, thereby, drive in rotation the slip clutch (10), wherein the control sleeve (14) and the driven sleeve (12) are rotationally decoupled;

wherein the driving sleeve (11) is positively guided in such a way that the driving sleeve (11), which is axially biased under pressure by the spring (13), is displaced axially away from the driven sleeve (12) and rotated relative to the control sleeve (14) when a limiting torque is exceeded and then is displaced axially towards the driven sleeve (12) under action of the spring (13), whereby the driving sleeve (11) strikes the driven sleeve (12) with the torque-transmitting flank surfaces (20) so that a rotational energy of the driving sleeve (11) is transformed into a brief tangential percussion which is transmitted to the tool by the tool receptacle.

16. A hand-held machine tool according to claim 15, wherein the first control contour (19*a*) is formed as a broad pocket with at least one side extending axially at an inclination, and the second control contour (19*b*) is formed as an elongated groove which extends at least partially at an opposite inclination axially.

17. A hand-held machine tool according to claim 16, wherein the first control contour (19*a*) is formed as a triangular pocket whose apex is situated axially on the spring side and whose two sides extend, respectively, at an inclination axially, and the second control contour (19*b*) is formed as an elongated groove which extends axially at an opposite inclination so as to be angled in a V-shaped manner.

18. A hand-held machine tool according to claim 15, wherein the control sleeve (14) is arranged coaxially inside the driving sleeve (11).

19. A hand-held machine tool according to claim 15, wherein at least two cams (9) are distributed circumferentially in a symmetric manner for the driving sleeve (11) and driven sleeve (12), respectively.

20. A hand-held machine tool according to claim 15, further comprising a transmission gear unit (16), said transmission gear unit (16) being driven by said driving motor (15) to rotate said impact mechanism (5), wherein a second safety clutch (17) is arranged in the flow of force between the driver motor (15) and the transmission gear unit (16).

* * * * *